US007302801B2

(12) United States Patent
Chen

(10) Patent No.: US 7,302,801 B2
(45) Date of Patent: Dec. 4, 2007

(54) LEAN-STAGED PYROSPIN COMBUSTOR

(75) Inventor: Daih-Yeou Chen, San Diego, CA (US)

(73) Assignee: Hamilton Sundstrand Corporation, Rockford, IL (US)

( * ) Notice: Subject to any disclaimer, the term of this patent is extended or adjusted under 35 U.S.C. 154(b) by 674 days.

(21) Appl. No.: 10/827,573

(22) Filed: Apr. 19, 2004

(65) Prior Publication Data

US 2005/0229604 A1 Oct. 20, 2005

(51) Int. Cl.
*F23R 3/34* (2006.01)

(52) U.S. Cl. ..... 60/733; 60/746; 60/754

(58) Field of Classification Search ..... 60/722, 60/733, 746, 752, 754, 804
See application file for complete search history.

(56) References Cited

U.S. PATENT DOCUMENTS 3,934,409 A * 1/1976 Quillevere et al. ..... 60/733
5,749,219 A 5/1998 DuBell
5,794,449 A * 8/1998 Razdan et al. ..... 60/746
6,481,209 B1 11/2002 Johnson et al.
6,484,509 B2 11/2002 Kraft et al.
6,530,223 B1 3/2003 Dodds et al.
7,146,816 B2 12/2006 Anderson et al.
2006/0037323 A1 2/2006 Reynolds et al.

* cited by examiner

*Primary Examiner*—L. J. Casaregola
(74) *Attorney, Agent, or Firm*—Carlson, Gaskey & Olds

(57) ABSTRACT

A combustor assembly includes a combustor chamber having a primary and intermediate zone that provides for reduced flame temperatures. The combustor assembly includes first and second pluralities of injectors. The first plurality of injectors introduces fuel to a primary zone. A second plurality of injectors introduces fuel to an intermediate zone. During operation between initial start up and before the introduction of engine load, fuel is introduced into the primary zone only by the first plurality of injectors. Once engine load is applied to the engine, fuel is introduced into the intermediate zone by the second plurality of injectors. Introduction of additional volume of fuel allows the fuel-air ratio to remain constant regardless of engine operating conditions. The constant fuel-air ratio is maintained at a desired rate to lower flame temperatures and reduce nitrous oxide emissions.

14 Claims, 4 Drawing Sheets

LEAN-STAGED PYROSPIN COMBUSTOR

BACKGROUND OF THE INVENTION

This invention relates generally to a combustor and specifically to a combustor including features reducing nitrous oxide ($NO_x$) emissions.

Conventional gas turbine engines include a combustor for mixing and burning a fuel air mixture to produce an exhaust gas stream that turns a turbine. Conventional combustors operate near stoichiometric conditions in the primary zone. Such conditions produce higher than desired combustor temperatures. The high combustor temperatures produce greater than desired amounts of nitrous oxide. Environmental concerns and regulation have created the demand for gas turbine engines with reduced nitrous oxide emissions.

Current combustors utilize many different configurations to optimize burning of fuel within the combustor. Many of these configurations include devices for initiating swirl of the fuel and air mixture within the combustor. Such devices improve the efficiency of fuel burning within the combustor. However, each of these devices requires a compromise of the two desirable conditions. That is, during the starting condition the fuel-air ratio is not exactly as would otherwise be desired because of the performance requirements required of the gas turbine engine under full load conditions. As appreciated, the compromise between optimal starting conditions and optimal engine operating conditions results in sacrifices being made for each engine operating condition.

Accordingly, it is desirable to develop a combustor that operates at a reduced temperature to reduce nitrous oxide emissions while providing desired starting and operating performance.

SUMMARY OF THE INVENTION

This invention is a combustor that includes first and second plurality of independently operable injectors that introduce fuel to select portions of the combustor.

The combustor of this invention includes a reverse-flow annular chamber that includes features that encourage complete fuel-air mixture. The combustion chamber includes a primary zone and an intermediate zone. In the primary zone, fuel and air is introduced through a first plurality of injectors. This first plurality of injectors includes dual orifice injectors that provide fuel-air mixture to the primary zone. During initial start up operations of the gas turbine engine the first plurality of injectors introduces the fuel-air mixture only into the primary zone. An igniter disposed within the primary zone ignites the fuel-air mixture.

Fuel is introduced into the intermediate zone of the combustion chamber by a second plurality of injectors. The second plurality of injectors includes an orifice that is directed to introduce fuel into the intermediate zone. The fuel-air mixture introduced into the primary and intermediate zones are essentially the same to provide a consistent lean fuel-air mixture. The additional quantity of fuel-air mixture into the combustor increases the power output of the engine. The additional fuel-air mixture in the intermediate zone at the same fuel-air ratio as is introduced in the primary zone and provides for the increase of power without increasing the fuel-air ratio or temperature within the combustor.

Accordingly, the combustor of this invention provides for optimal operation of a gas turbine engine during starting conditions and during engine load operating conditions without an increase in temperature to therefore reduce nitrous oxide emissions.

These and other features of the present invention can be best understood from the following specification and drawings, the following of which is a brief description.

DETAILED DESCRIPTION OF THE PREFERRED EMBODIMENT

Figure 1:
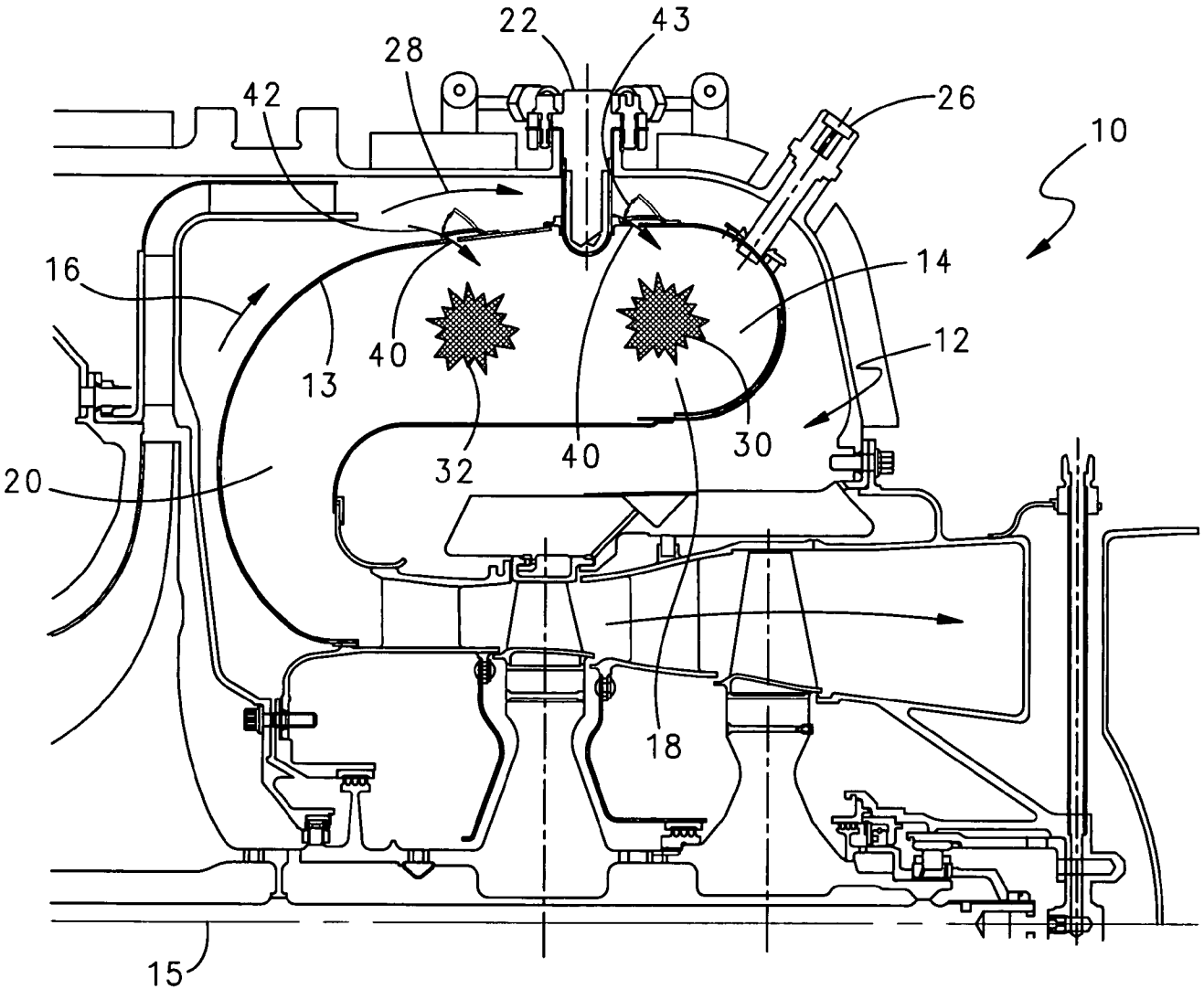
FIG. 1 is a cross-sectional view of a section of the combustor chamber of this invention.

Referring to FIG. 1, a gas turbine engine assembly 10 includes a combustor 12 that includes a combustor chamber 14. The combustor chamber 14 includes an interior portion 18 and an outlet portion 20. Within the interior portion 18 is a primary zone 30. Adjacent the outlet portion 20 is an intermediate zone 32. The combustor chamber 14 illustrated is of a reverse annular configuration. A worker with the benefit of this disclosure would understand the application of this invention to combustors of other designs and configurations.

The combustor 12 includes a first plurality of injectors 22. The combustor 12 further includes a second plurality of injectors 24 (Best shown in FIG. 3). Each of the first and second pluralities of injectors 22, 24 are disposed in the combustor 12 at a position adjacent both the primary and intermediate zones 30, 32.

The combustor 12 also includes a plurality of effusion openings 40 that communicate high-pressure air into the combustor chamber 14. The effusion openings 40 are illustrated much larger than actual size to illustrate the configuration of the combustor 12. The effusion openings 40 are small holes with a diameter of approximately 0.020 inches. Each of the effusion openings 40 is angled relative to the combustor chamber 14 to initiate swirling of combustion gases. Swirling of the combustion gases within the combustor chamber 14 provides for more efficient combustion. The swirling of the air and fuel within the combustor chamber 14 initiates optimal combustion and also produces fire swirling. Further, the swirling of the combustion gases produces a favorable and uniform temperature distribution throughout the combustor chamber 14. The favorable temperature distribution further optimizes combustion of the fuel-air mixture within the combustor.

The effusion openings 40 are disposed about the circumference of the combustor chamber 14 and are angled relative to an inner surface 13 of the combustor 12. Preferably, the effusion openings 40 are disposed at a swirl angle 42 of between 45° and 90°. The angle 42 is shown schematically for clarity and would be arranged transverse to the axis 15 to initiate rotational swirling within the combustor chamber 14. The effusion openings 40 include a down angle 43 of between 15° and 45° downstream. The angles 42 and 43 are shown schematically for clarity. Other angles for the effusion openings 40 are within the contemplation of this invention to provide desired swirling and mixing for combustors of differing configurations.

The first and second pluralities of injectors 22, 24 are actuatable independent of each other. An inlet passage 16 communicates fuel and air to the first and second pluralities of injectors 22, 24. The inlet passage 16 is shown schematically and is not necessarily the only configuration that can be utilized with this invention.

The fuel-air mixture within the combustor 12 is ignited by a plurality of igniters 26. The igniters 26 ignite the fuel-air mixture within the combustor chamber 14 to produce gases that exit as indicated at 34. These gasses exit the combustor 12 to drive a turbine as is know in the art.

During initial start up conditions fuel is injected only into the primary zone 30. In the primary zone 30 the igniter 26 ignites the fuel-air mixture to produce the exhaust gasses 34. Initial operating conditions include the starting point to a ready to load condition. Under these conditions it is desirable to enable engine operation and specifically to provide for high altitude starting.

The fuel-air ratio within the combustor 12 is preferably regulated within a range of approximately 0.027 to 0.041. Fuel-air ratios are related as a normalized equivalent ratio. The normalized equivalent ratio is a measure known to those skilled in the art for relating desired fuel-air ratios with different fuel grades and compositions. The combustor 12 of this invention operates at an approximate normalized equivalent ratio range between 0.40 and 0.60. The lower equivalent ratio provides more air than fuel. This range of fuel-air mixture minimizes flame temperature. Minimizing flame temperature within the combustor 12 provides for lower nitrous oxide emissions. Lower nitrous oxide emissions are desirable to minimize environmental impact. The fuel-air ratio disclosed is for example purposes and a worker with the benefit of this disclosure would understand that other fuel-air ratios are within the contemplation of this invention.

During a starting condition, the gas turbine engine assembly 10 performs optimally at higher fuel-air mixtures within the combustor 12. The selected fuel-air ratio within the combustor 12 provides improved high altitude starting performance.

The same conditions that are desirable for high altitude starting are not desirable for operating the gas turbine engine assembly 10 under full load to provide maximum required amount of power. Increasing the amount of power produced by the gas turbine engine assembly 10 is accomplished by increasing fuel volume within the combustor chamber 14. The second plurality of injectors 24 for this invention injects fuel into the intermediate zone 32 during ready engine load conditions. The increased volume of fuel-air mixture within the combustor 12 provides the desired increase in engine power. This is accomplished without increasing the flame temperature within the combustor chamber 14 and thereby without an increase in the levels of nitrous oxide emission from the combustor 12.

Figure 2:
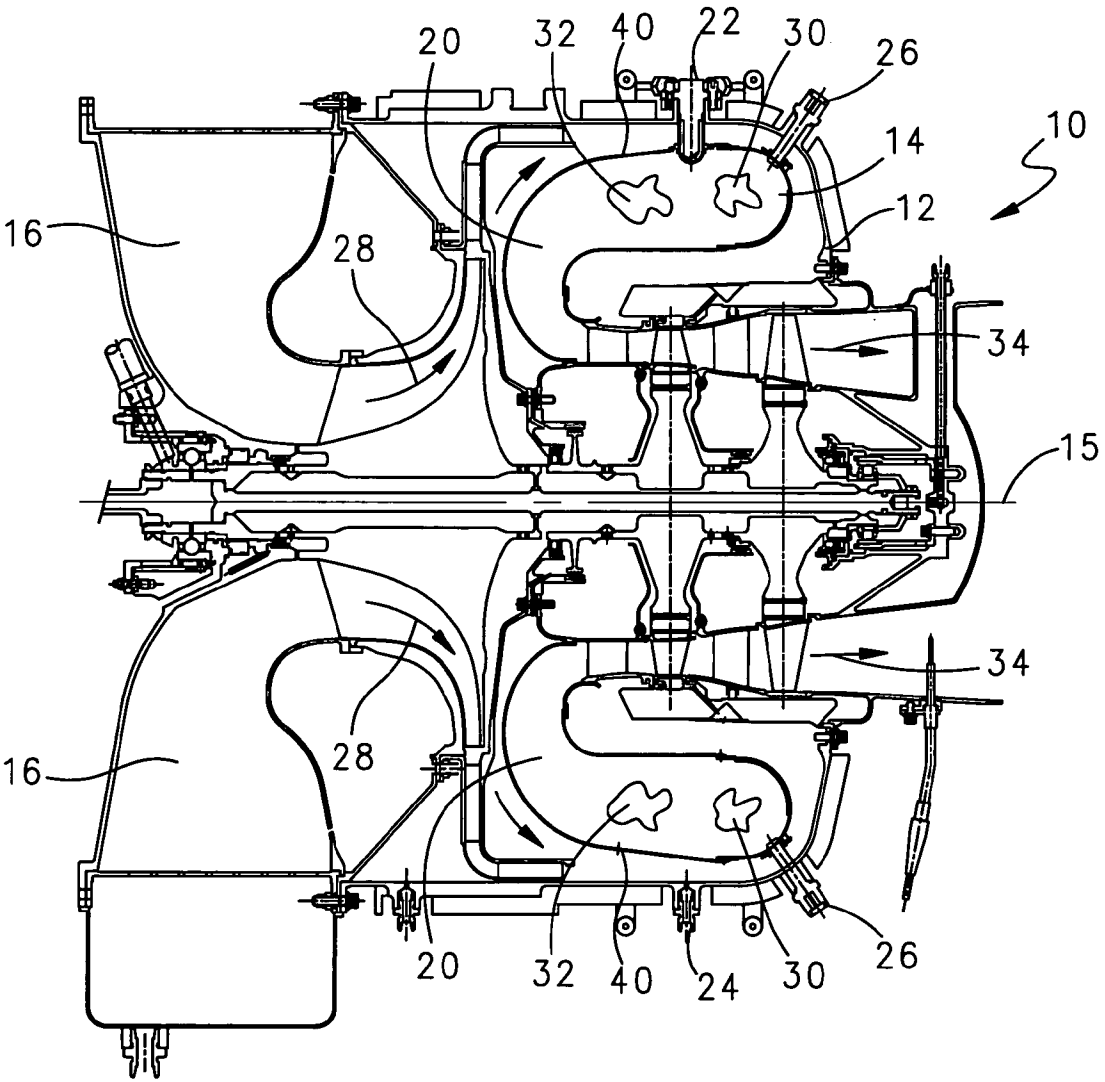
FIG. 2 is a cross-sectional view of the annular combustor chamber of this invention.
Figure 3:
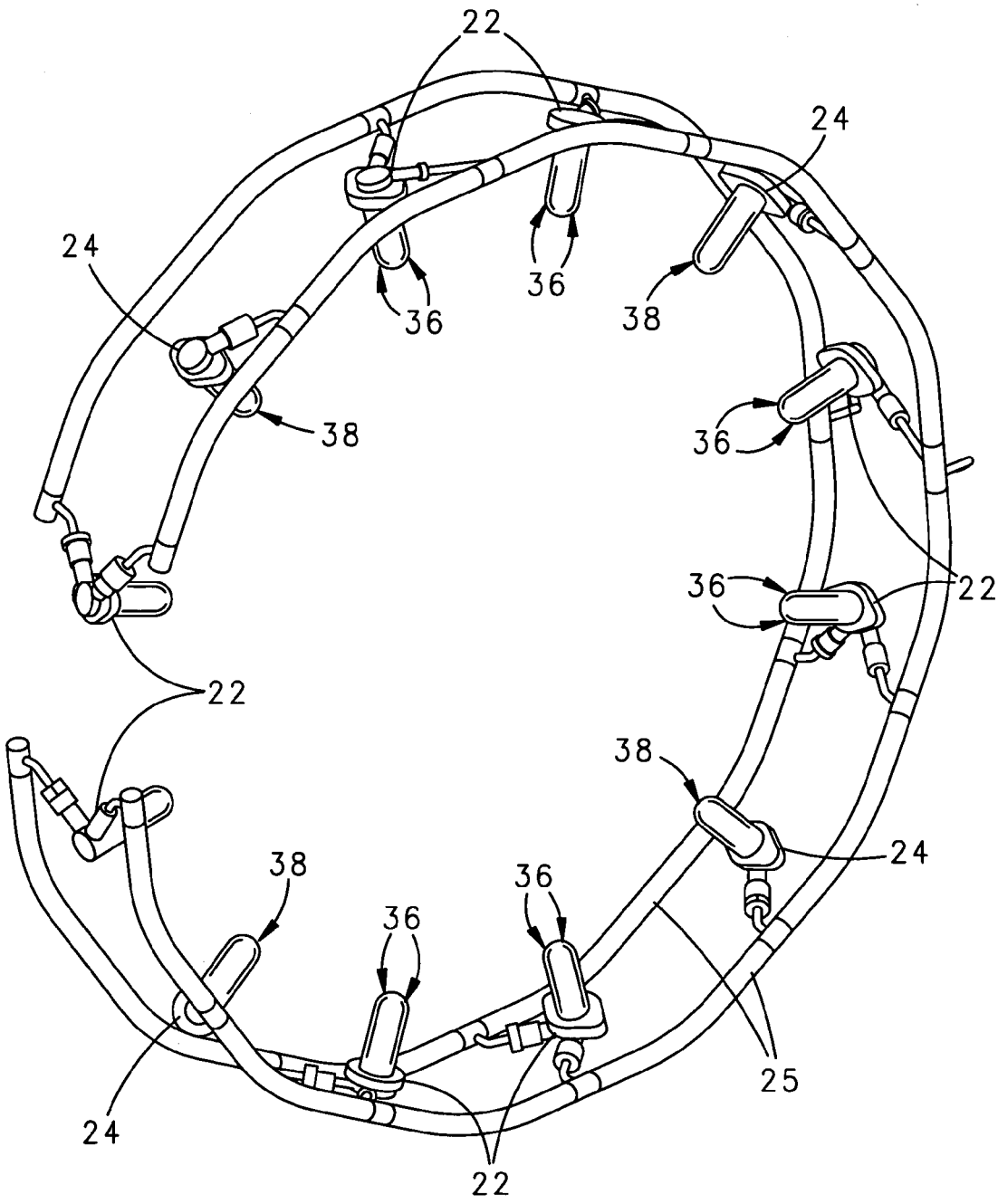
FIG. 3 is a perspective view of the outside of the combustor and fuel injectors.

Referring to FIG. 2, another cross-sectional view of the gas turbine engine assembly 10 is illustrated. The first plurality of injectors 22 include injectors all having dual orifices 36 (FIG. 3). The orifices 36 are directed both towards the primary zone 30. The second plurality of injectors 24 includes a single orifice 38 (FIG. 3) directed towards the intermediate zone 32. During initial starting conditions fuel is emitted into the combustor chamber 14 only by the first plurality of injectors 22 into the primary zone 30. After the gas turbine engine assembly 10 has attained ready to load conditions, fuel is emitted from the second plurality of injectors 24 into the intermediate zone 32 that is adjacent the outlet portion 20 of the combustor chamber 14.

The increase in fuel-air volume within the combustor 12 provides the desired increases in engine power. Although, engine power is increased, the flame temperature is not increased because a consistent fuel-air mixture ratio is disposed throughout the entire combustor chamber 14. The only increase is in the volume of fuel-air mixture. The selective actuation of the second plurality of injectors 24 produces increased engine power with out an increase in flame temperatures. Further, the selective actuation of the first and second pluralities of injectors 22, 24, provide for desired operation of the gas turbine engine assembly 10 both at initial starting conditions and during engine load operating conditions.

Figure 4:
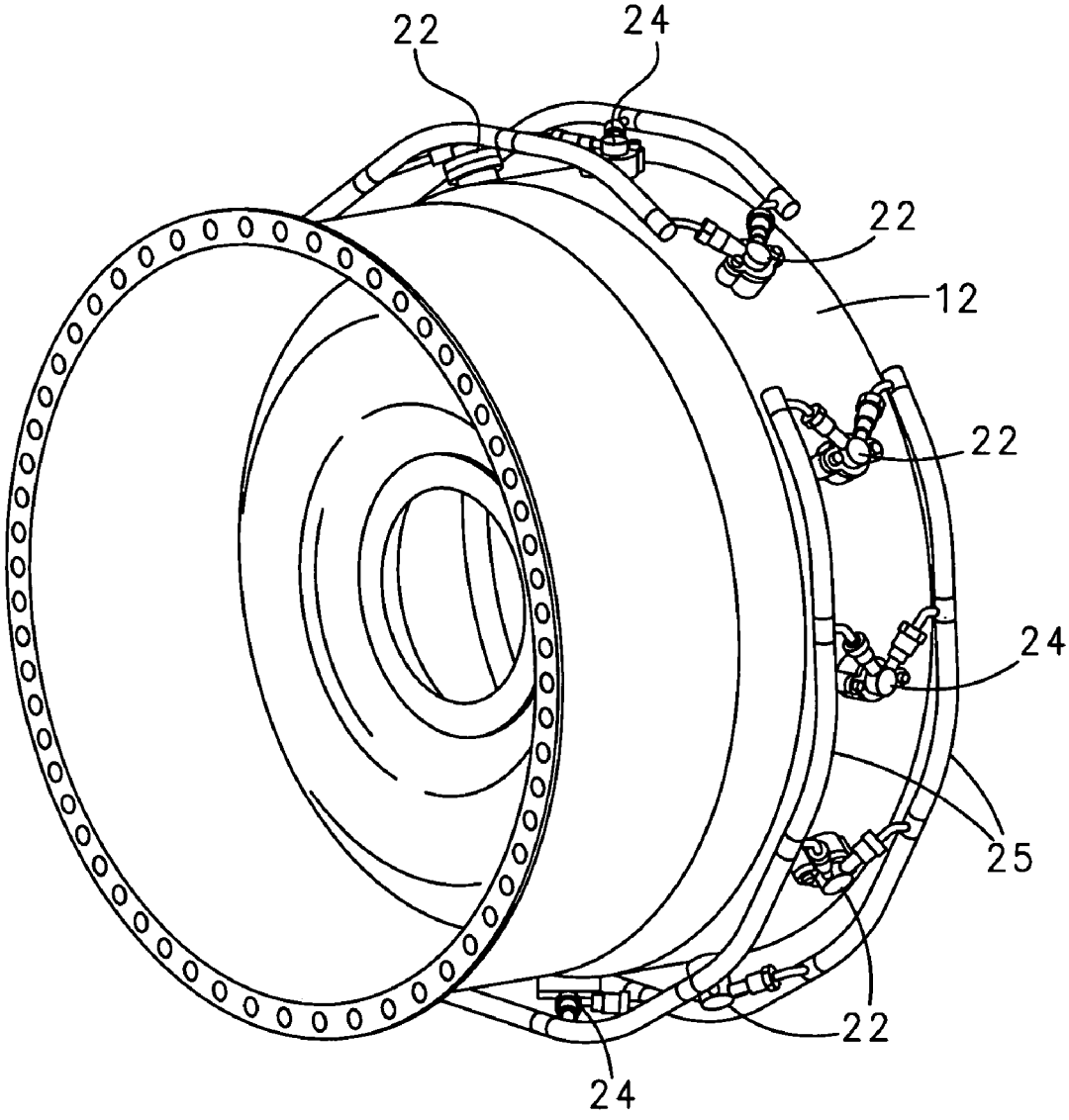
FIG. 4 is a perspective view of the fuel injectors separate from the combustor.

Referring to FIGS. 3 and 4, the combustor 12 is shown with the first and second plurality of injectors 22, 24 disposed radially about the combustor 12. The first and second plurality of injectors 22,24 are supplied with fuel by fuel lines 25. Preferably, each of the injectors 22,24 is mounted within the combustor 12 between the intermediate and primary zones 30,32 as shown in FIGS. 1 and 2. Further, the first and second plurality of injectors 22,24 are spaced an equal distance about the outer circumference of the combustor 12.

In this exemplary embodiment the first plurality of injectors 22 includes eight injectors each having dual orifices 36. The second plurality of injectors 24 includes four injectors each including the single orifice 38. Although, specific numbers and positions of injectors are illustrated a worker with the benefit of this disclosure would understand that different configurations and types of injectors are applicable to this invention.

Operation of the gas turbine engine assembly 10 of this invention includes the steps of introducing fuel into the primary zone 30 within the combustor chamber 14 with the first plurality of injectors 22. Fuel is injected into the primary zone 30 to provide a desired fuel-air ratio that provide favorable and reliable engine starting characteristics at high altitudes. The first plurality of injectors 22 operate alone to introduce fuel into the combustor chamber 14 from initial start up to the beginning of load application on the gas turbine engine assembly 10.

Increased power for the application of load to the gas turbine engine assembly 10 is provided for by actuation of the second plurality of injectors 24. The second plurality of injectors 22 engages to introduce fuel into the intermediate zone 32 within the combustor chamber 14. The introduction of fuel into the intermediate zone 32 provides the increase in fuel-air mixture volume that provides the desired engine power output. The increase in volume without increasing the fuel-air mixture ratio provides for the desired power output without increasing the temperature within the combustor 12. The stable and reduced flame temperature within the combustor 12 produces substantially less nitrous oxide emissions as compared to conventional gas turbine engines.

The combustor 12 according to this invention provides optimal operating conditions both during initial start up and during maximum engine loads. This is accomplished by selectively actuating the first and second plurality of injectors 22, 24 according to the desired operating conditions. Further, the angled effusion openings 40 swirl air and fuel entering the combustor chamber 14 to provide a consistent uniform pattern factor and flame temperature throughout the entire combustor 12. The spin of fuel-air mixture within the combustor chamber 14 along with the change in the volume of the fuel-air mixture burned within the combustor chamber 14 optimizes combustor performance. The change of the volume of the fuel-air mixture is independent of the change in the fuel-air ratio that remains consistent during the entire operation from initial start up to maximum engine load.

Providing a consistent fuel-air mixture that provides reduced flame temperatures during combustion that in turn decreases in nitrous oxide emissions.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A combustor assembly comprising:

a combustor chamber comprising a primary and an intermediate zone, and a plurality of effusion openings for initiating swirling of combustion gases;

a fuel igniter adjacent said primary zone;

a first plurality of fuel injectors supplying fuel into said primary zone; and a second plurality of fuel injectors supplying fuel into said intermediate zone, wherein said first and second plurality of fuel injectors are actuatable independent of each other for selectively supplying fuel to said primary and intermediate zones.

2. The assembly as recited in claim 1, wherein said combustor chamber comprises an annular reverse flow chamber.

3. The assembly as recited in claim 1, wherein said effusion openings comprise a swirl angle and a down angle.

4. The assembly as recited in claim 1, wherein said first plurality of injectors comprises dual orifices for injection of fuel into said combustor chamber.

5. The assembly as recited in claim 1, wherein said second plurality of injectors comprises single orifice injectors.

6. The assembly as recited in claim 1, wherein said first plurality of injectors injects fuel into said primary zone during initial start up.

7. The assembly as recited in claim 1, wherein said second plurality of injectors injects fuel into said intermediate zone at a predetermined time after initial start up.

8. The assembly as recited in claim 7, wherein said predetermined time corresponds with an applied engine load.

9. The assembly as recited in claim 1, wherein said combustor chamber comprises an outlet and an end portion and said intermediate zone is disposed adjacent said outlet portion, and said primary zone is disposed adjacent said end portion.

10. The assembly as recited in claim 1 wherein said combustor assembly is part of an auxiliary power unit.

11. A gas turbine engine assembly comprising:

a combustor chamber comprising a primary and an intermediate zone, and a plurality of effusion openings for initiating swirling of combustion gases;

a fuel igniter adjacent said primary zone;

a first plurality of injectors for supplying fuel into said primary zone; and a second plurality of injectors for supplying fuel into said intermediate zone, wherein said first and second plurality of injectors are separately actuatable for supplying fuel to each of said primary and intermediate zones.

12. The assembly as recited in claim 11, wherein said combustion chamber comprises an annular reverse flow combustion chamber.

13. The assembly as recited in claim 11, wherein said first plurality of injectors comprise dual orifices directed toward said primary zone, and said second plurality of injectors include a single orifice directed toward said intermediate zone.

14. The assembly as recited in claim 11, wherein said first plurality of injectors supplies fuel to said primary and intermediate zones during a start condition, and said first and second pluralities of injectors supply fuel to said primary and intermediate zones upon attaining a desired operating condition.

* * * * *